United States Patent [19]

Birke et al.

[11] 3,930,791

[45] Jan. 6, 1976

[54] PROCESS FOR THE DYEING OF SYNTHETIC FIBROUS MATERIAL FROM ORGANIC SOLVENTS

[75] Inventors: Walter Birke; Franz Schön, both of Frankfurt am Main; Willi Steckelberg, Hofheim, Taunus, all of Germany

[73] Assignee: Hoechst Aktiengesellschaft, Frankfurt am Main, Germany

[22] Filed: Nov. 1, 1973

[21] Appl. No.: 411,749

[30] Foreign Application Priority Data

Nov. 7, 1972 Germany ..... 2254377

[52] U.S. Cl. ..... 8/1 B; 8/1 C; 8/41 R; 8/41 A; 8/41 B; 8/41 C; 8/41 D; 8/174

[51] Int. Cl.[2] ..... D06P 1/38

[58] Field of Search ..... 8/174, 1 B, 1 C, 41 R, 8/41 A, 41 B, 41 C, 41 D; 260/193

[56] References Cited

UNITED STATES PATENTS

| | | | |
|---|---|---|---|
| 3,792,972 | 2/1974 | Brenneisen et al. | 8/41 R X |
| 3,792,973 | 2/1974 | Brenneisen et al. | 8/41 R X |

*Primary Examiner*—Lewis T. Jacobs
*Attorney, Agent, or Firm*—Curtis, Morris & Safford

[57] ABSTRACT

A process for the continuous dyeing of textile materials consisting of, or containing, synthetic fibrous materials of the group consisting of high molecular polyamides, polyolefins, polyacrylonitriles, polyurethanes, polyvinylchlorides, polyvinylacetates, cellulose-2½-acetate, cellulose-triacetate and high molecular polyesters, which comprises impregnating the said fibrous materials with an organic dyebath containing at least one dyestuff of the formula

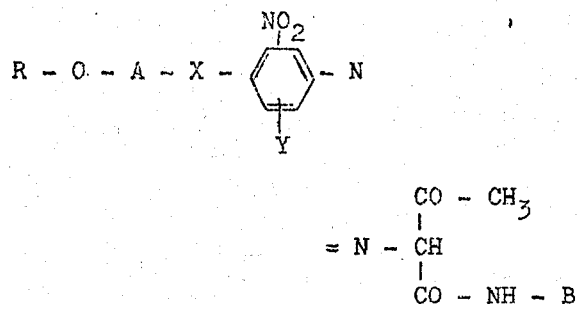

in which R represents a linear or branched alkylcarbonyl radical of at most 20 carbon atoms or the naphthoyl group being unsubstituted or substituted on the naphthalene nucleus by lower alkyl, X represents an oxygen or sulfuratom, Y represents hydrogen, chlorine or bromine, A represents a linear or branched alkylene groups of 1 to 4 carbon atoms unsubstituted or substituted by methoxy, ethoxy, phenoxy or R being defined as above, and B represents (1) phenyl unsubstituted or substituted by fluorine chlorine, bromine, alkyl or 1 to 4 carbon atoms, alkoxy of 1 to 4 carbon atoms, trifluoromethyl, cyano, carboalkoxy, nitro, acetyl, benzoyl, phenoxy or phenyl, or (2) naphthyl, and heating the impregnated and heated fibrous materials to a temperature between 100° and 240°C.

4 Claims, No Drawings

PROCESS FOR THE DYEING OF SYNTHETIC FIBROUS MATERIAL FROM ORGANIC SOLVENTS

This invention provides a novel process for the continuous dyeing of textile materal consisting of synthetic fibers of containing the same, from organic solvents which comprises impregnating the fibrous material with an organic dyeing liquor containing dyestuffs of the formula (1)

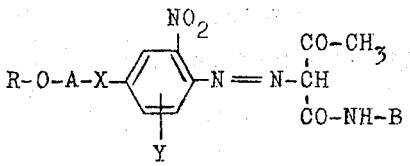

(1)

in which R stands for a linear or branched alkyl carbonyl radical or a substituted or unsubstituted aryl carbonyl radical with 20 carbon atoms at most, X represents an oxygen atom or a sulfur atom, Y stands for a hydrogen, chlorine or bromine atom, A stands for a linear or branched alkylene group containing 1 to 4 carbon atoms which can be substituted by a methoxy, ethoxy or phenoxy group or the radical R, B represents a phenyl radical that can be substituted by fluorine, chlorine or bromine atoms, by alkyl and/or alkoxy groups having 1 to about 4 carbon atoms, by trifluoromethyl, cyano, carbalkoxy, nitro, acetyl, benzoyl, phenoxy and/or phenyl groups, or may represent a naphthyl radical, and subsequently fixing the dyestuffs by subjecting the impregnated fibrous material to a heat treatment.

Preferably used are dyeing liquors containing dyestuffs of the formula (2)

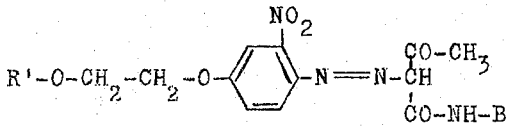

(2)

in which R′ stands for a linear or branched alkyl carbonyl radical containing 2 to about 12 carbon atoms and has the meaning given above.

It is possible by means of the dyestuffs used in the process of dyeing synthetic fiber material from organic solvents, to obtain dyeings which are characterized by a high color yield, a very good build-up as well as outstanding fastness properties, in particular excellent fastness to sublimation (ironing), fastness to washing, to rubbing and to light. Another advantage of the dyestuffs to be used in this process in their good solubility in organic solvents, as for example, in alcohols and especially in halogenated hydrocarbons, whereby the dyeing process may be optionally carried out also without solubilizers. The above-mentioned dye-bath, preferably used which contain the particularly valuable dyestuffs of the formula (2) yield on the said fiber materials dyeings having a very good fastness to light and to sublimation (ironing).

Mixtures of the dyestuff being used according to the process of this invention yield sometimes a better color yield than the individual dyestuffs and they show sometimes a better solubility in the organic medium.

As synthetic fiber materials there may be used those consisting of high-molecular polyamides, polyolefins or polyacrilonitriles, furthermore materials consisting of polyurethanes, polyvinyl chlorides, polyvinyl acetates as well as cellulose-2 ½-acetate and cellulose triacetate, in particular those of high-molecular polyesters, such as polyethylene terephthalate. The said synthetic fibers may also be blended with one another or with natural fibers, such as cellulosic fibers or wool. These fibrous materials may be dyed in any state of processing suitable for a continuous operation, for example, as cables, combed material, filaments, yarns, knit or woven fabrics or as non-woven articles.

As organic solvents to be used for the process of the invention, such substances are suitable which boil at temperatures not exceeding 150°C under normal conditions, for example aliphatic hydrocarbons, such as the corresponding "Special boiling point spirits (cuts)" (DIN — 51 631/I. 59), aliphatic halogenated hydrocarbons, such as methylene chloride, dichloro-ethane, trichloro-ethane, tetrachloro-ethane, dichloro-fluoromethane, dichloro-tetrafluoro-ethane and octafluoro-cyclobutane; aromatic hydrocarbons such as toluene and xylene; aromatic halogenated hydrocarbons, such as chlorobenzene and fluorobenzene. Especially suitable are trichlorofluoromethane, 1,2,2-trichloro-1,1,2-trifluoro-ethane, tetrachloro-ethylene, trichloro-ethylene and 1,1,1-trichloro-ethane.

Suitable solvents for this invention are also, for example, alcohols, preferably aliphatic alcohols having up to 4 carbon atoms. Mixtures of various solvents have proved to be suitable, especially, for example, mixtures of halogenated aliphatic hydrocarbons and/or aliphatic alcohols.

The padding liquors are prepared by dissolving the dyestuffs in the solvent or solvent mixture while stirring, and where required, while heating. For this purpose, the dyestuffs may be used in various forms, for example free from standardizing agents, as a concentrated solution in a solvent used according to the invention or in a mixture thereof or as a composition using auxiliaries soluble in solvents, for example oxalkylation products of fatty alcohols, alkyl-phenols, fatty acids and fatty acid amides.

The dyestuff solutions are applied onto the material most advantageously by padding, but also by other impregnation methods, such as spraying, slop-padding or immersing.

The impregnation operation is preferably carried out at room temperature but it may also be performed at higher or lower temperatures.

Prior to the dyestuff fixation, the textile material which has been treated with the dyeing liquor is then preferably dried, for example, by treating it with hot air, suctioning an inert gas (such as nitrogen) or air through it or applying superheated vapors, for example steam or solvent vapor, or by establishing a vacuum.

Subsequently, the dyestuffs are fixed by elevated temperatures, for example by means of hot air, dry heat, steam or solvent vapor.

The fixation temperature to be observed depend on the melting point of the fiber type chosen and are generally between 100° and 240°C for the padding method. The heat treatment may be carried out in superheated steam or in vapors of organic solvents, moreover with the aid of molten metals, paraffins, waxes, oxalkylation products of alcohols or fatty acids or in eutectic mixtures of salts, preferably by means of dry heat, i.e. according to the so-called Thermosol Process. It is also possible to carry out the drying operation and the heat treatment in a single operation.

The solvent vapors which escape during the drying or fixing operation are generally collected in suitable devices. The solvents thus recovered may then be used once more for the described dyeing process.

After the dyestuffs have been fixed, the unfixed dyestuff portion, if any, is removed by a suitable aftertreatment of the dyed material in order to improve the fastness properties regaring utilization of the goods. This aftertreatment is preferably performed in the same organic solvent as already used for the dyeing but it may also be carried out in different organic solvents or in aqueous liquors according to known methods.

The dyestuffs used in the process of this invention are prepared in known manner by acylation dyestuffs of the above formula (1) or (2), but with the proviso that R or R′ represent a hydrogen atom, with a carboxylic acid of the formula (3) or (4),

R—OH (3)
R′—OH (4)

in which R or R′ stand as defined above, or preferably with a functional derivative such as the acid anhydride or an acid halide, for example acid bromide or preferably acid chloride, at temperatures between 20° and 100°C approximately, advantageously in an inert organic solvent and optionally in the presence of an acid-binding agent. Preferably used as an acid-binding agent is pyridine, a mixture of pyridine bases, quinoline or a low-molecular trialkylamine, for example triethylamine.

When using a halide of the acid with the named formula (3), it is advantageous to add an acid-binding agent to the esterification mixture.

Suitable as inert organic solvents are for example hydrocarbons such as benzene, toluene, xylene; halogenated hydrocarbons such as chloroform, carbon tetrachloride, methylene chloride, trichloroethylene, chlorobenzene, bromobenzene; ketones such as acetone, methyl ethyl ketone, methyl isobutyl ketone; furthermore ether as for example diethyl ether, diisopropyl ether, dioxane, 1,2-dimethoxy ethane, methoxybenzene or ethoxybenzene as well as sulfolane (tetramethylene sulfolane).

The following Examples illustrate the invention. Parts and percentages are by weight unless stated otherwise.

EXAMPLE 1

8 Parts of the dyestuff of the formula

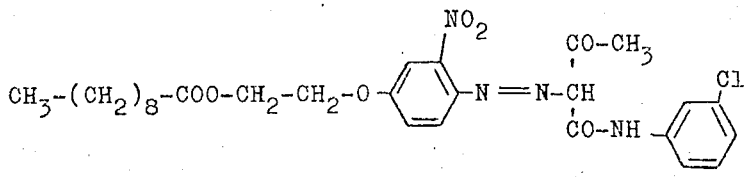

were dissolved in 1000 parts by volume of trichloroethylene at room temperature. This dyestuff solution was used to pad-dye a fabric made of polyester fibers on a padding machine, the squeezing effect being 75% (weight of the padding liquor calculated on the weight of the dry meterial). The pad-dyed material was then dried in a suitable apparatus and thermosoled for 1 minute at 210°C. A fast yellow dyeing was obtained.

Similar results could be obtained when using instead of trichloroethylene the same amount by volume of perchloroethylene.

The dyestuff was obtained by dissolving the dyestuff of the formula

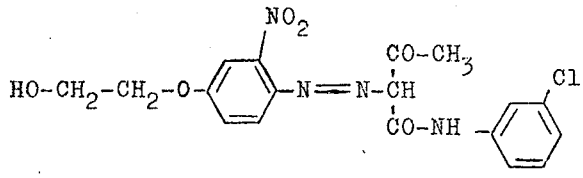

in chloroform and by acylation through heating with the acid chloride of the formula in known manner $CH_3 - (CH_2)_4 - CO - Cl$ in the presence of pyridine.

EXAMPLE 2

10 Parts of the dyestuff of the formula

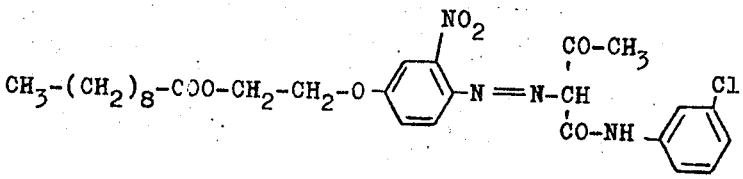

and 10 parts of the dyestuff of the formula

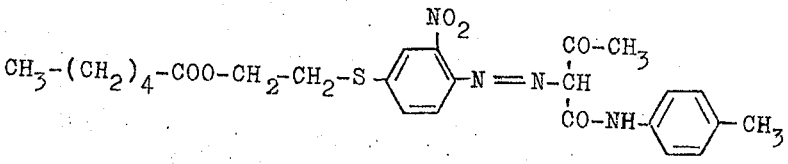

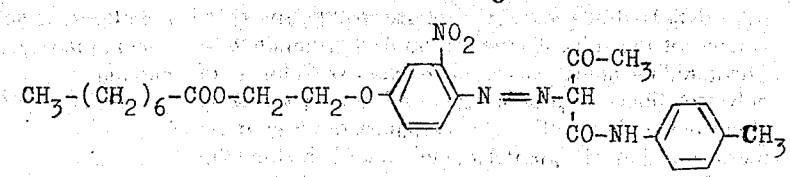

were dissolved in 1000 parts by volume of perchloroethylene at room temperature. This padding liquor was used to pad-dye a fabric of polyester fibers on a padding machine, the squeezing effect being 80% by weight. Then, the fabric was dried, thermosoled for 1 minute at 210°C and washed for 5 minutes in cold perchloro-ethylene. A fast yellow dyeing was obtained. The dyestuffs were obtained by dissolving the dyestuff of the formula

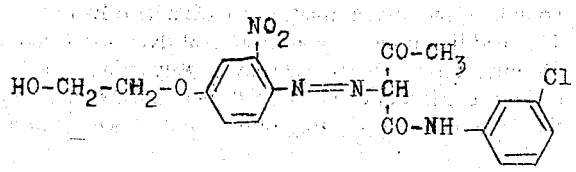

in toluene and by acylating in known manner by heating with the acid chloride of the formula $CH_3 - (CH_2)_8 - CO - Cl$ in the presence of pyridine, and by acylating the dyestuff of the formulla

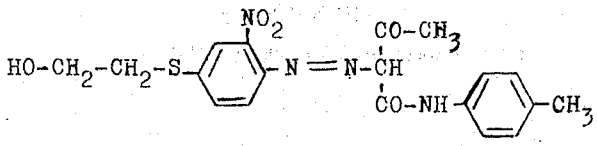

in corresponding manner with the acidchloride of the formula $CH_3 - (CH_2)_4 - CO - Cl$

EXAMPLE 3

8 Parts of the dyestuff of the formula

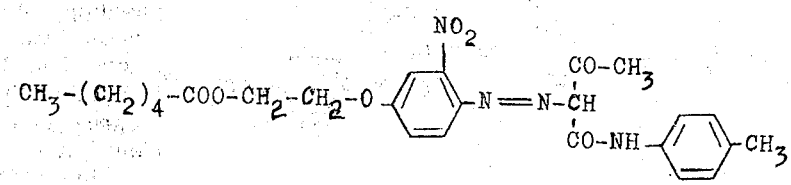

were dissolved in 1000 parts by volume of perchloroethylene at about 25°C. This dyestuff solution was used to pad-dye the following textile materials: fabrics made of polyester fibers, polyamide-6 and polyamide-6,6 fibers, cellulose-2 ½-acetate fibers, cellulose-triacetate fibers and fabrics made of polyvinyl chloride and polypropylene fibers. The squeezing effect varied, according to the kind of material used, between 60 and 85%. After padding, the textile materials were dried, steamed for about 40 minutes and then after-washed for 10 minutes in cold perchloroethylene. In all cases, fast yellow dyeings were obtained. The dyestuff was obtained by acylating the dyestuff of the formula

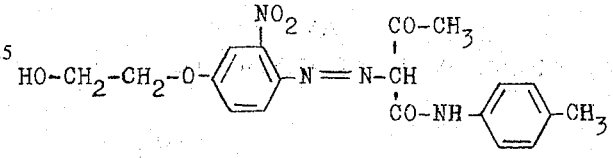

in toluene in the presence of pyridine as acid-binding agent with the acid chloride of the formula $CH_3 - (CH_2)_6 - CO - Cl$

EXAMPLE 4

10 Parts of the dyestuff of the formula

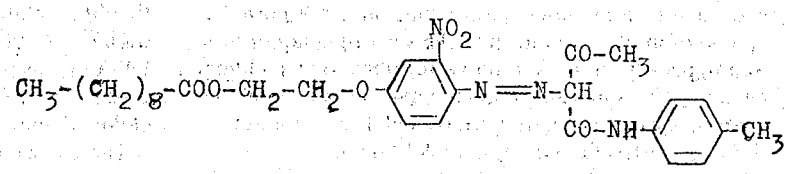

were dissolved at room temperature in a mixture of 1000 parts by volume of 50.5% 1,2,2-trifluoro-trichloro-ethane and 49.5% methylene chloride. This liquor was used to pad-dye a fabric of polyester fibers on a padding machine, the squeezing effect being 80%; then the material was dried, thermosoled at 210°C for 1 minute and washed in cold state for 5 minutes in the same solvent mixture. A fast yellow dyeing was obtained. The dyestuff was obtained as described in Example 3 by acylating it with the acid chloride of the formula $CH_3 - (CH_2)_6 - CO - Cl$

EXAMPLE 5

5 Parts of the dyestuff of the formula were dissolved at room temperature in 1000 parts by volume of the solvent mixture defined in Example 4. This padding liquor was used to pad-dye a fabric of polyester fibers on a padding machine, the squeezing effect being about 80%. Then the material was dried, thermosoled at 210°C for 1 minute and washed in cold state for 5 minutes in perchloroethylene. A fast yellow dyeing was obtained.

The dyestuff was obtained as described in Example 3 by acylating it with the acid chloride of the formula $CH_3 - (CH_2)_4 - CO - Cl$

EXAMPLE 6

7 Parts of the dyestuff of the formula

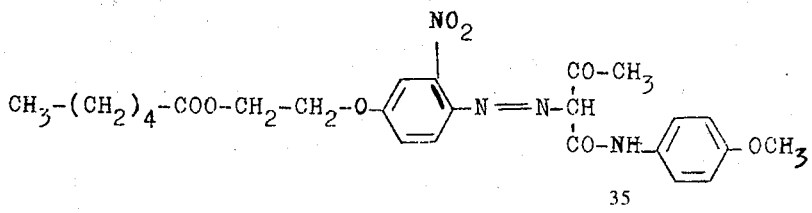

were dissolved at room temperature in 1000 parts by volume of methylene chloride. This padding liquor was used to pad-dye a fabric of poyester fibers on a padding machine, the squeezing effect being 65 %. Then the material was dried and thermosoled for 1 minute at 210°C. A fast yellow dyeing was obtained.

The dyestuff was prepared in known manner by acylating the dyestuff of the formula

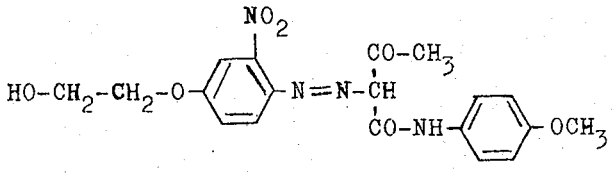

in benzene solution and by adding triethylamine as an acid-binding agent with the acid chloride of the formula $CH_3 - (CH_2)_6 - CO - Cl$

EXAMPLE 7

5 Parts of the dyestuff

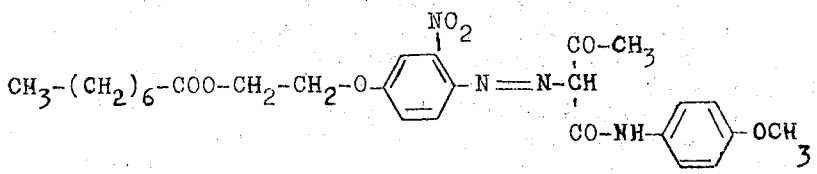

The dyestuff was obtained as described in Example 3 by acylating it with the acid chloride of the formula $CH_3 - (CH_2)_1 - CO - Cl$

EXAMPLE 6

7 Parts of the dyestuff of the formula were dissolved at room temperature in 1000 parts by volume of methylene chloride. This padding liquor was used to pad-dye a fabric of poyester fibers on a padding machine, the squeezing effect being 65 %. Then the material was dried and thermosoled for 1 minute at 210°C. A fast yellow dyeing was obtained.

The dyestuff was prepared in known manner by acylating the dyestuff of the formula were dissolved at room temperature in 1000 parts by volume of the solvent mixture mentioned in Example 4. This padding liquor was used to pad-dye fabrics made of polyester fibers, polyamide-6, polyamide 6,6 and celluoose triacetate fibers on a padding machine and then dried. The squeezing effects varied according to the fiber material used between 65 and 80%. After drying, the fabrics were thermosoled for 1 minute at 190°C (polyester fabrics at 210°C) and subsequently washed cold for 5 minutes in perchloroethylene. Fast yellow dyeings were obtained.

The dyestuff was prepared as described in Example 6, but without use of the acid chloride of the formula $CH_3 - (CH_2)_6 - CO - Cl$

EXAMPLE 8

5 Parts of the dyestuff of the formula

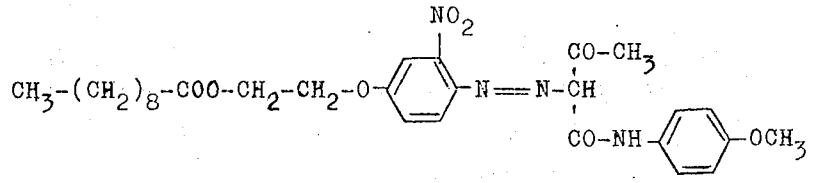

were dissolved in 1000 parts by volume of 1,1,1-trichloroethane at about 25°C. This padding liquor was used to pad-dye a fabric of polyester fibers on a padding machine with a squeezing effect of 65%. Then the material was dried and thermosoled for 1 minute at 210°C. A fast yellow dyeing was obtained.

The dyestuff was prepared as describes in Example 6, but by using the acid chloride of the formula $CH_3 - (CH_2)_8 - Co - Cl$

EXAMPLE 9

10 Parts of the dyestuff of the formula

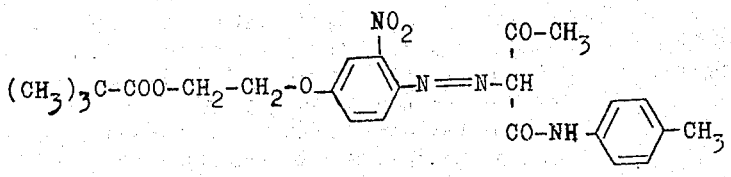

were dissolved at room temperature in 1000 parts by volume of perchloroethylene. This dyestuff solution was used to pad-dye a fabric of polyester fibers on a padding machine with a squeezing effect of 80%. Then the material was dried, thermosoled for 1 minute at 210°C and washed cold for 5 minutes in perchloroethylene. A fast yellow dyeing was obtained.

Similar results could be obtained when the dyestuff was fixed not by hot air but by a steaming process (30 minutes at 102° to 103°C in water steam or 10 minutes at 150°C in overheates perchloroethylene vapor).

The dyestuff was prepared as described in Example 3, but by using the acid chloride of the formula $(CH_3)_3C - CO - Cl$

EXAMPLE 10

5 Parts of the dyestuff of the formula

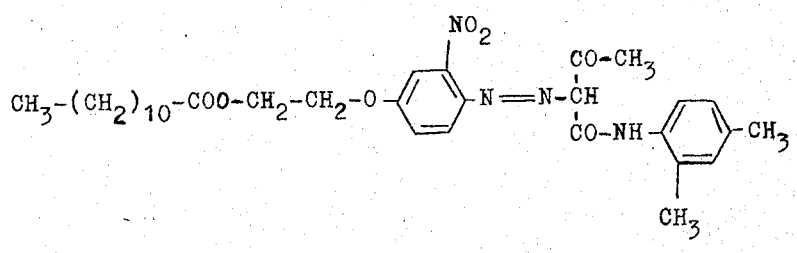

were dissolved in a mixture of 70% by volume of perchloroethylene and 30 % by volume of methanol at room temperature. This padding liquor was used to pad-dye a fabric of polyester fibers on a padding machine. The squeezing effect amounted to about 70%. After padding, the material was dried and thermosoled for 1 minute at 210°C. A fast yellow dyeing was obtained.

The dyestuff was obtained by acylating the dystuff of the formula

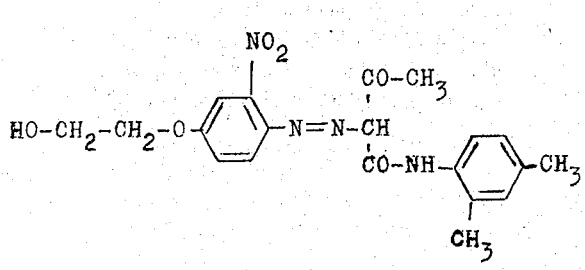

with the acid chloride of the formula $CH_3 - (CH_2)_{10} - CO - Cl$

EXAMPLE 11

6 Parts of the dyestuff describes in Example 1 were dissolved in 1000 parts by volume of perchloroethylene at room temperature. This padding liquor was used to pad-dye a mixed fabric of 67% of polyester fibers and 33% of cotton on a padding machine, the squeezing effect being 85%; then the material was dried and thermosoled for 1 minute at 210°C. Then the dyeing was washed cold for 5 minutes in perchloroethylene. A fast yellow dyeing was obtained on the polyester portion of the mixed fabric.

EXAMPLE 12

2 Parts of the dyestuff mentioned in Example 6 were dissolved in 1000 parts by volume of methanol at 40°C. This liquor was used to pad-dye a fabric of polyester fibers on a padding machine, the sqeezing effect being about 40%. After padding, the material was dried and thermosoled for 1 minute at 210°C. A fast yellow dyeing was obtained.

EXAMPLE 13

7 Parts of the dyestuff of the formula

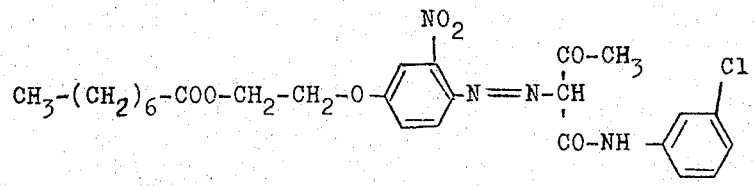

were dissolved in 1000 parts by volume of perchloroethylene at room temperature. This liquor was used to pad-dye a fabric of polyester fibers on a padding machine, the sqeezing effect being about 80%. Then the fabric was dried and thermosoled for 1 minute at 210°C. A fast yellow dyeing was obtained.

A similar result could be obtained when replacing the perchloroethylene by the same amount of a mixture containing 49.5% of methylene chloride and 50.5% of 1,2,2-trifluorotrichluoro-ethane.

The dyestuff was prepared as defined in Example 1, but by the use of the acid chloride of the formula $CH_3(CH_2)_6 - CO - Cl$ Further dyestuffs to be used according to the process of this invention are listed in the following Table under the general formula (1)

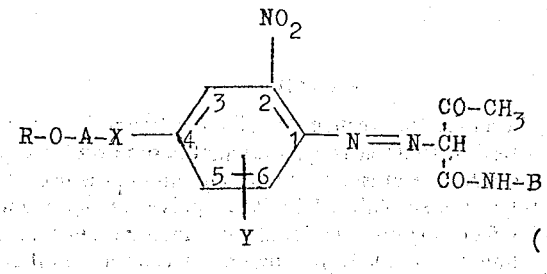

(1)

These dyestuffs yield according to the above-described dyeing prescription yellow to orange dyeings on polyester fibers.

in which R represents a linear or branched alkylcarbonyl radical of at most 20 carbon atoms or the naphthoyl group being unsubstituted or substituted on the naphthalene nucleus by lower alkyl, X represents an oxygen or sulfuratom, Y represents hydrogen, chlorine or bromine, A represents a linear or branched alkylene groups of 1 to 4 carbon atoms unsubstituted or substituted by methoxy, ethoxy, phenoxy, or R being defined as above, and B represents (1) phenyl unsubstituted or substituted by fluorine, chlorine, bromine, alkyl of 1 to 4 carbon atoms, alkoxy of 1 to 4 carbon atoms, trifluoromethyl, cyano, carboalkoxy, nitro, acetyl, benzoyl, phenoxy or phenyl, or (2) naphthyl, and heating the impregnated fibrous materials to a temperature between 100° and 240°C.

2. The process as claimed in claim 1, wherein the organic solvent in the dyebath is an organic solvent having a boiling point of at most 150°C under standard conditions.

3. The process as claimed in claim 1, wherein the organic solvent in the dyebath is an aliphatic hydrocarbon, aliphatic chlorinated hydrocarbon, aromatic hydrocarbon, chlorinated aromatic hydrocarbon, aliphatic alcohol having 1 to 4 carbon atoms, or mixtures thereof, the boiling point of which not exceeding 150°C under standard conditions.

| Example No. | X | Y | A | B | R |
|---|---|---|---|---|---|
| 14 | O | H | $-C_2H_4-$ | 4-t-Butyl-phenyl | $CH_3Co-$ |
| 15 | O | H | $-C_2H_4-$ | 4-t-Butyl-phenyl | $(CH_3)_2CHCO-$ |
| 16 | O | H | $-C_2H_4-$ | 4-t-Butyl-phenyl | $(CH_3)_2CH(CH_2)_4CO-$ |
| 17 | O | H | $-C_2H_4-$ | α-Naphthyl | $CH_3(CH_2)_4CO-$ |
| 18 | O | H | $-C_2H_4-$ | 4-Fluoro-phenyl | $CH_3(CH_2)_4CO-$ |
| 19 | O | H | $-C_2H_4-$ | 2-Bromo-phenyl | $CH_3(CH_2)_4CO-$ |
| 20 | O | H | $-C_2H_4-$ | 3-Trifluoromethyl-phenyl | $CH_3(CH_2)_4CO-$ |
| 21 | O | H | $-C_2H_4-$ | 2-Nitro-phenyl | $CH_3(CH_2)_4CO-$ |
| 22 | O | H | $-C_2H_4-$ | 3-Cyano-phenyl | $CH_3(CH_2)_4CO-$ |
| 23 | O | H | $-C_2H_4-$ | 2-Carbobutoxy-phenyl | $CH_3(CH_2)_4CO-$ |
| 24 | O | H | $-C_2H_4-$ | 4-n-Butoxy-phenyl | $CH_3(CH_2)_4CO-$ |
| 25 | O | H | $-C_2H_4-$ | 3-Acetyl-phenyl | $CH_3(CH_2)_6CO-$ |
| 26 | O | H | $-C_2H_4-$ | 3-Benzoyl-phenyl | $CH_3(CH_2)_6CO-$ |
| 27 | O | H | $-C_2H_4-$ | 2-Ethoxy-phenyl | $CH_3(CH_2)_6CO-$ |
| 28 | O | H | $-C_2H_4-$ | 4-Phenoxy-phenyl | $CH_3(CH_2)_6CO-$ |
| 29 | O | H | $-C_2H_4-$ | 4-Phenyl-phenyl | $CH_3(CH_2)_6CO-$ |
| 30 | S | H | $-C_2H_4-$ | 4-i-Propyl-phenyl | $CH_3(CH_2)_6CO-$ |
| 31 | S | 6-Br | $-C_2H_4-$ | 4-t-Butyl-phenyl | $CH_3(CH_2)_6CO-$ |
| 32 | S | H | $-C_2H_4-$ | 4-Bromo-phenyl | $CH_3(CH_2)_6CO-$ |
| 33 | S | H | $-C_2H_4-$ | 4-Methyl-phenyl | $(CH_3)_3CCO-$ |
| 34 | O | 5-Cl | $-C_2H_4-$ | 2,4.Dimethyl-phenyl | $CH_3(CH_2)_4CO-$ |
| 35 | O | H | $-CH_2-$ | 4-Phenyl-phenyl | $CH_3(CH_2)_4CO-$ |
| 36 | O | H | $-CH_2CH(OCO(CH_2)_2CH_3)CH_2-$ | α-Naphthyl | $CH_3(CH_2)_2CO-$ |
| 37 | O | H | $-(CH_2)_3-$ | 4-t-Butoxy-phenyl | $CH_3(CH_2)_6CO-$ |
| 38 | O | H | $-CH(CH_2-O-C_6H_5)-CH_2-$ | 4-t-Butoxy-phenyl | $CH_3(CH_2)_6CO-$ |
| 39 | O | H | $-CH(CH_2-OCH_3)-CH_2-$ | 4-Ethyl-phenyl | $CH_3(CH_2)_2CO-$ |
| 40 | O | H | $-C_2H_4-$ | 4-t-Butyl-phenyl | $C_6H_5CO-$ |
| 41 | O | H | $-C_2H_4-$ | 4-i-Propyl-phenyl | $4-CH_3-C_6H_4CO-$ |

We claim:

1. A process for the continuous dyeing of textile materials consisting of, or containing, synthetic fibrous materials of the group consisting of high molecular polyamides, polyolefins, polyacrylonitriles, polyurethanes, polyvinylchlorides, polyvinylacetates, cellulose-2 ½-acetate, cellulose-triacetate and high molecular polyesters, which comprises impregnating the said fibrous materials with an organic dyebath containing at least one dyestuff of the formula

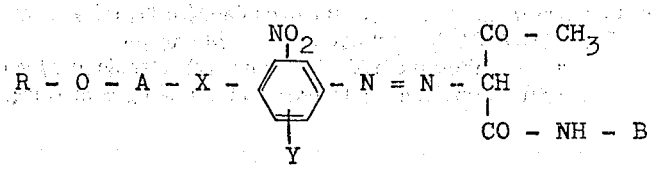

4. The process as claimed in claim 1, wherein the organic solvent in the dyebath is a special boiling point spirit, methylenechloride, dichloroethane, trichloroethane, trichloro-fluoro-methane, trichloroethylene, tetrachloroethane, tetrachloroethylene, dichlorofluoromethane, trichloro-trifluoro-ethane, dichloro-tetrafluoro-ethane, octafluoro-cyclobutane, toluene, xylene, chlorobenzene or fluorobenzene, or mixtures thereof.

* * * * *